US007004718B2

(12) United States Patent
Braner et al.

(10) Patent No.: US 7,004,718 B2
(45) Date of Patent: Feb. 28, 2006

(54) DOWNENDER TRANSPORT TABLE

(76) Inventors: Harold R. Braner, HWB, Inc., 12128 Prosperity Farms Rd., Palm Beach Gardens, FL (US) 33410; Tadeusz Marecki, 4016 N. Kostner Ave., Chicago, IL (US) 60641

( * ) Notice: Subject to any disclaimer, the term of this patent is extended or adjusted under 35 U.S.C. 154(b) by 314 days.

(21) Appl. No.: 10/328,976

(22) Filed: Dec. 24, 2002

(65) Prior Publication Data

US 2004/0146391 A1 Jul. 29, 2004

(51) Int. Cl.
*B66F 11/00* (2006.01)

(52) U.S. Cl. ..... 414/783; 414/684; 414/778; 414/910; 414/911

(58) Field of Classification Search ..... 414/684, 414/778, 783, 910, 911
See application file for complete search history.

(56) References Cited

U.S. PATENT DOCUMENTS

| | | | | |
|---|---|---|---|---|
| 2,700,332 A * | 1/1955 | Donald | 100/2 |
| 4,807,350 A * | 2/1989 | Hasenkamp | 29/430 |
| 5,332,351 A * | 7/1994 | Nelson et al. | 414/684 |
| 5,341,911 A * | 8/1994 | Gamberini et al. | 198/409 |
| 6,354,197 B1 * | 3/2002 | Bordignon et al. | 100/7 |

* cited by examiner

*Primary Examiner*—Janice L. Krizek
(74) *Attorney, Agent, or Firm*—Greenberg Traurig LLP

(57) ABSTRACT

An improved downender device for translating heavy objects such as steel coils from a vertical configuration to a horizontal configuration. Comprises a downender transport table having a center channel, a drive chain disposed in said center channel, and an arbor for receiving heavy objects. The arbor may extend and retract without interfering with the drive chain, which includes a series of catchers for pushing the heavy objects along a table of rollers.

8 Claims, 8 Drawing Sheets

DOWNENDER TRANSPORT TABLE

BACKGROUND OF THE INVENTION

1. Field of the Invention

The present invention relates in general to machinery for processing heavy objects and, more particularly, to a machine for translating heavy objects from a vertical configuration to a horizontal configuration.

2. Background Art

In the field of processing heavy objects and, more particularly, coils of steel, machinery is required to perform even the most mundane tasks. In the processing of steel coils, the coils are frequently manufactured in a vertical configuration. However, because the steel coils tend to roll when in this configuration, the steel coils must be laid on their sides before they can be safely transported. As steel coils can often weigh several tons, this is commonly accomplished by a downender transport table.

A typical downender transport table, according to the prior art, comprises a table of rollers, a section of which is designed as a coil receiving section and can move from a horizontal configuration to a vertical configuration. This coil receiving section of the table of rollers further includes an arbor for receiving a steel coil by slidably engaging the inner diameter of the steel coils.

In operation, the coil receiving section of the table of rollers moves to a vertical position, and the arbor then extends from the coil receiving section. The steel coil is pushed onto the arbor by a turnstile or other machine, and the coil receiving section of the downender transport table returns to its horizontal configuration. The arbor then retracts, and the rollers freely drive the steel coil down the processing line towards a stacking machine or other piece of equipment.

A drawback of this prior art configuration is that each roller in the downender transport table must be at least as wide as the steel coil. Because steel coils weigh several tons, the rollers bend under the weight of the steel coil; such bending reduces the useful life of the roller, which must be heavier and more costlier due to the weight of the coil. As will be appreciated by those skilled in the art, the amount of bending increases in direct proportion to the length of the roller. In addition, because the rollers are driven roller to roller by chain sprocket mechanisms at a constant rate, they endure additional unnecessary wear even when there are no steel coils to transport. It is therefore desirable to reduce roller wear in a downender transport table, in turn, reducing the cost of manufacturing the downender transport table and eliminate the chain sprocket mechanism on the rollers.

Another drawback of the current art arises from the fact that the steel coils tend not to stay in the center of the processing line. Rather, the steel coils have a tendency to move from side to side, as the result of variations in the roller speed, the uniformity of the rollers, the vibrations of the rollers and the level of the table amongst other reasons. This side to side movement of the steel coils can create several additional complications. For example, the steel coils may slide off of the side of the table, or may not stack properly if the they are not properly aligned prior to stacking.

Furthermore, this movement of the steel coils may affect other machines and sensors which perform operations on the steel coils. For example, a banding machine typically applies steel bands to the steel coils while they are moving down the processing line. The banding machine may malfunction if the center of the steel coil is not properly aligned with the machine, or if there is insufficient clearance between the steel coil and one of the sides of the processing line. Delicate sensors are also located on the sides of the processing line, and can be easily damaged by side-to-side movement of the steel coils. It is thus another object of this invention to keep the steel coils in the center of the processing line and prevent the steel coils from moving from side to side.

These and other objects will become apparent in light of the present specification, claims and drawings.

SUMMARY OF THE INVENTION

The present invention is directed towards a downender transport table comprising a table having a plurality of rollers and a downender receiving section for receiving an object and then translating the position of the object between a substantially vertical position and a substantially horizontal position. The object has an inner diameter which circumscribes an inner surface and an outer diameter which circumscribes is an outer surface.

The downender receiving section of the table also has an arbor for engaging the inner surface of the object and securing the object to the table during the repositioning between the vertical and the horizontal positions. The arbor is preferably comprised of two portions, an engaging portion for releasable engagement of the inner surface of the object and a support portion operably associated with the object engaging portion. In this embodiment, the support portion emanates from the object engaging portion aligned with but off-center from the inner diameter of the object towards maximizing space available within the inner diameter of the object.

The table itself includes a guide channel within the table. There is also an idler sprocket and a drive sprocket, both of which are positioned to cooperate with the guide channel. Around the idler sprocket and the drive sprocket is a drive connecting the two sprockets.

The invention also includes at least one catcher on the drive chain and positioned within the guide channel. The at least one catcher releasably engages the inner surface of the object so as to move the object along the table when the drive chain is in motion and the object is in the horizontal.

Preferably, there are a plurality of catchers attached to the drive chain that are spaced at regular intervals on the drive chain. The intervals are calculated and dependent upon the inner diameter of the object and the speed that the drive chain is moving. In this preferred embodiment, the guide channel will be positioned in the center of the table so as to substantially bisect the rollers within the table. As with the arbor, the catcher is positioned to conform to the inner surface of the object when the catcher engages the inner surface thereby minimizing the space taken up by the catcher within the inner diameter of the object.

DETAILED DESCRIPTION OF THE DRAWINGS

Figure 1:
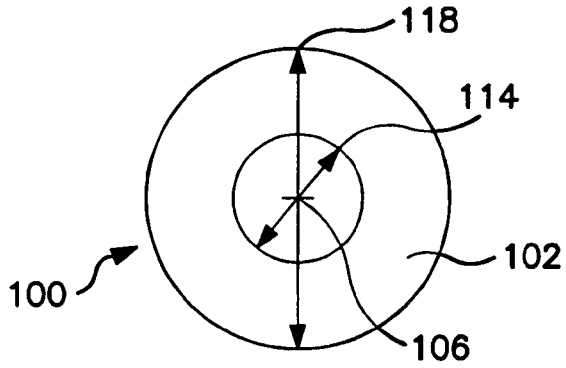
FIG. 1 is a side plan view of the steel coil.

While this invention is susceptible to embodiment in many different forms, there are shown in the drawings and will be described in detail herein several specific embodiments, with the understanding that the present disclosure is an exemplification of the principles of the invention, intended merely to explain and illustrate the invention, and is not intended to limit the invention in any way to embodiments illustrated.

A "downender" is a device used for translating heavy objects from a vertical position to a horizontal position. For example, downenders are frequently used in the processing of steel coils. As is well known to those skilled in the art, sheets of steel are commonly rolled into large coils. After being processed, the coils are typically in a vertical configuration (the diameter of the steel coil is vertical). Steel coils have a tendency to roll when in this configuration, so the coils must be placed flat on their side (so that the diameter of the steel coil is horizontal) before the coils can be safely transported. Because of the weight of the steel coils, this is usually accomplished by a downender transport table.

Figure 2:
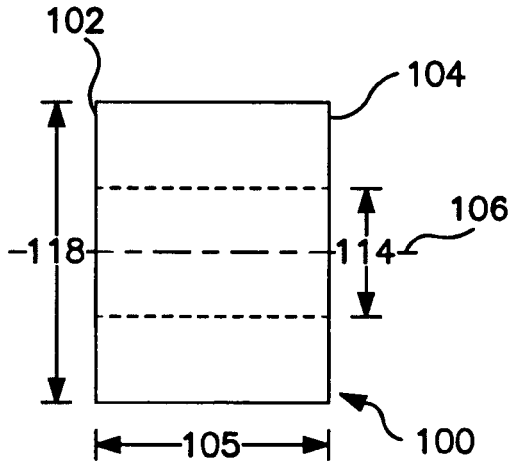
FIG. 2 is a front plan view of a steel coil.
Figure 3:
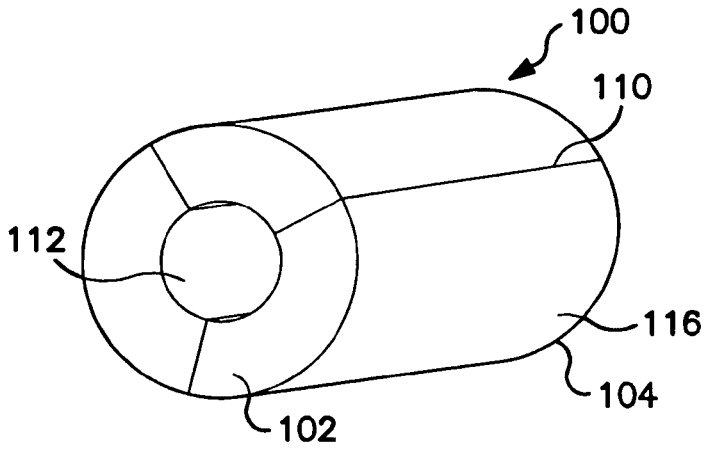
FIG. 3 is a perspective view of a steel coil.

A typical steel coil 100 is shown in FIGS. 1–3. The steel coil 100 comprises a cylindrical structure having first end 102 and second end 104, which in turn define width 105 of steel coil 100. Steel coil 100 further comprises inner surface 112 and outer surface 116, both of which are cylindrical in shape, and center axis 106. Inner surface 112 defines inner diameter 114, equal to twice the average distance from center axis 106 to inner surface 112. Likewise, outer surface 116 defines outer diameter 118 equal to twice the average distance from center axis 106 to outer surface 112. As will be appreciated by those skilled in the art, steel coils may be manufactured in a variety of sizes, having a variety of combinations of inner diameter, outer diameter, and width.

Figure 4:
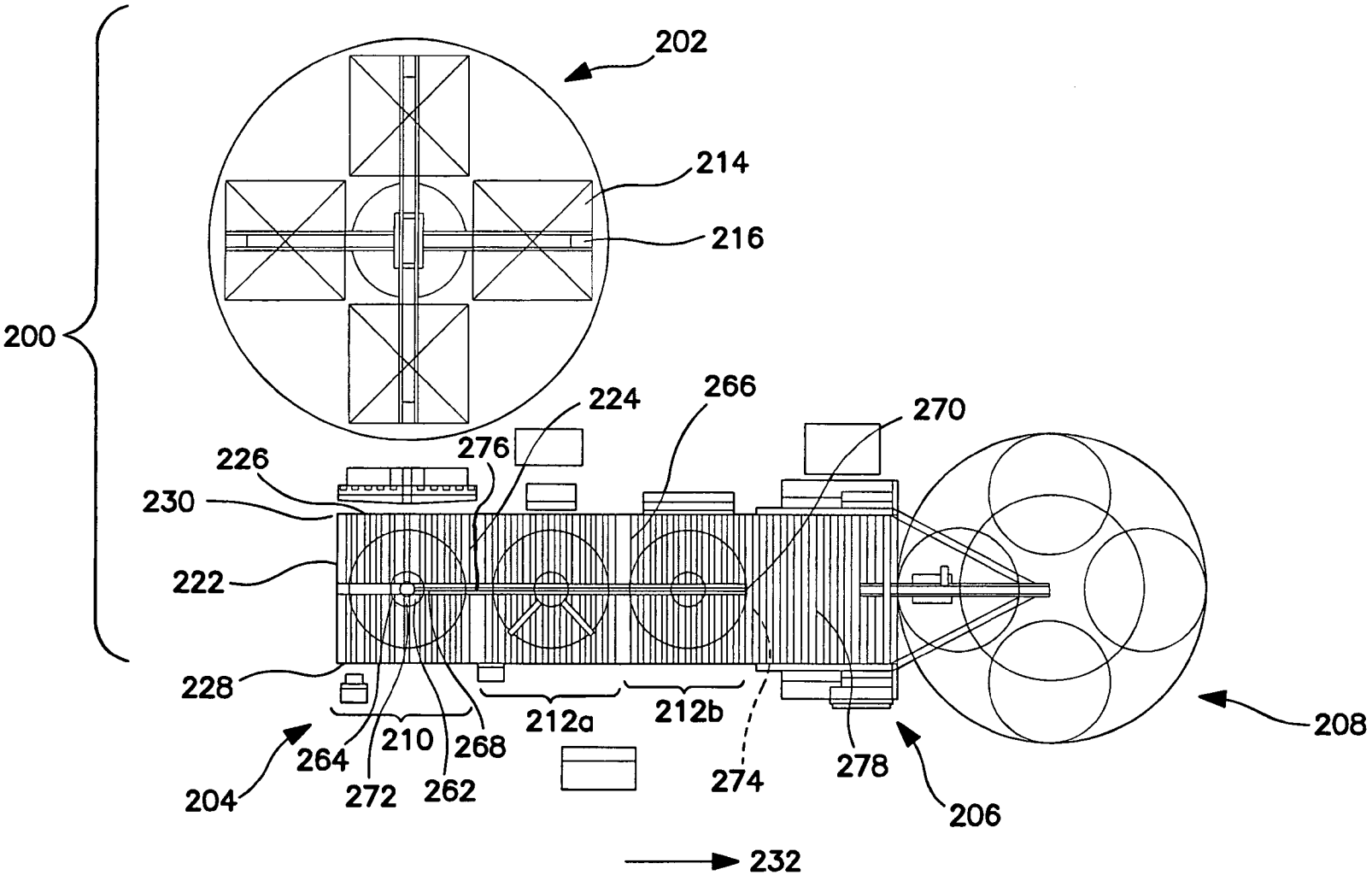
FIG. 4 is a top plan view of a steel processing line with a downender transport table.

FIG. 4 illustrates steel coil processing line 200, comprising turnstile 202, downender transport table 210, stacker 206, and receiving turntable 208. The turnstile 202 holds steel coils 214 on each of a plurality of arms 216. Each steel coil 214 is shown in a vertical configuration when on arm 216. Downender transport table 210 is adjacent to a plurality of transport sections 212*a–b,* which may include a binding machine such as 212*a*. Downender transport table 210 has first end 222 and second end 224, as well as first side 226 and second side 228. Steel coils 214 are processed in the direction of flow path 232.

In operation, downender transport table 210 receives steel coil 214 from turnstile 202, and repositions steel coil 214 from a vertical configuration to a horizontal configuration. Steel coil 214 is then moved in the direction of flow paths 232 by the series of transport sections 212. At the end of processing line 200, steel coil 214 is stacked with other steel coils onto turntable 208 by stacker 206. Processing line 200 may optionally include additional structures, as needed, adjacent downender transport table 210 for processing steel coils 214. For example, the processing line 200 may have a banding machine associated with one of the transport sections 212*a*, for banding the steel coils with high strength steel bands.

Figure 5:
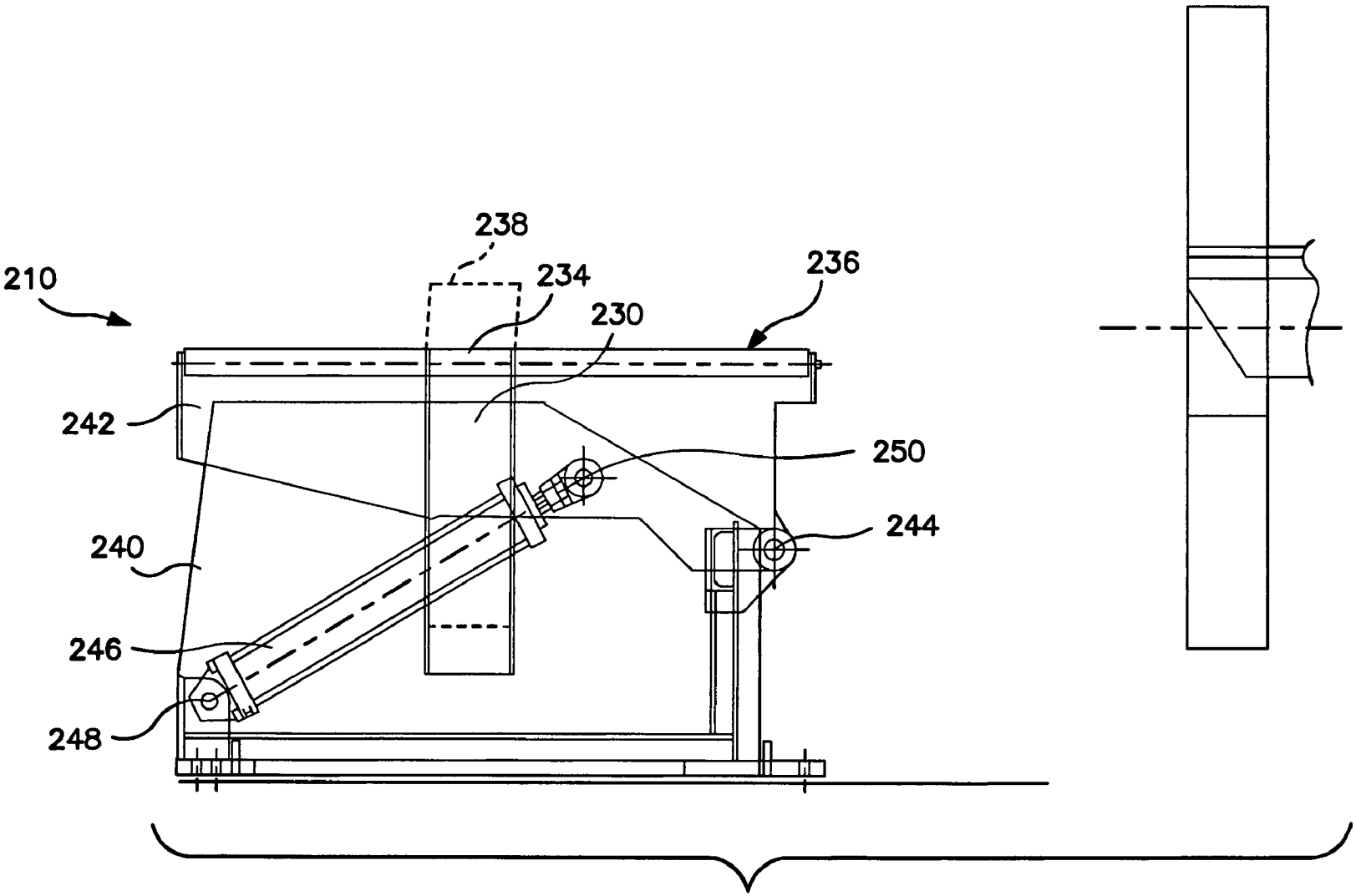
FIG. 5 is a side view of a downender transport table in a horizontal configuration.

Turning to FIG. 5, downender transport table 210 includes base portion 240, upper portion 242, hinge 244, piston 246, and arbor 230. Piston 246 has first piston end 248 and second piston end 250. First piston end 248 is rotatably connected to base portion 240, while second piston end 250 is rotatably connected to upper portion 242. Upper portion 242 and base portion 240 of downender transport table 210 are further connected to each other via hinge 244. Hinge 244 is preferably disposed along first side 226 of downender transport table 210, though those skilled in the art will recognize that other configurations are possible in accordance with the present invention. Upper portion 242 also includes upper edge 236.

Arbor 230, which, according to the prior art, is typically cylindrical in shape, is disposed in the center of downender transport table 210. Arbor 230 has a first arbor end 234. First arbor end 234 is configured to be substantially planar with upper edge 236 of upper hinged portion 242 when arbor 230 is in a first, retracted position. Arbor 230 is further configured to extend from the first, retracted position to a second, extended position as indicated by the dashed line at 238.

Piston 246 is also configured to extend from a first, retracted position to a second extended position, causing upper hinged portion 242 of downender transport table 210 to rotate about hinge 244. When piston 246 is in its first, retracted position, upper edge 236 of upper portion 242 is horizontal.

Figure 6:
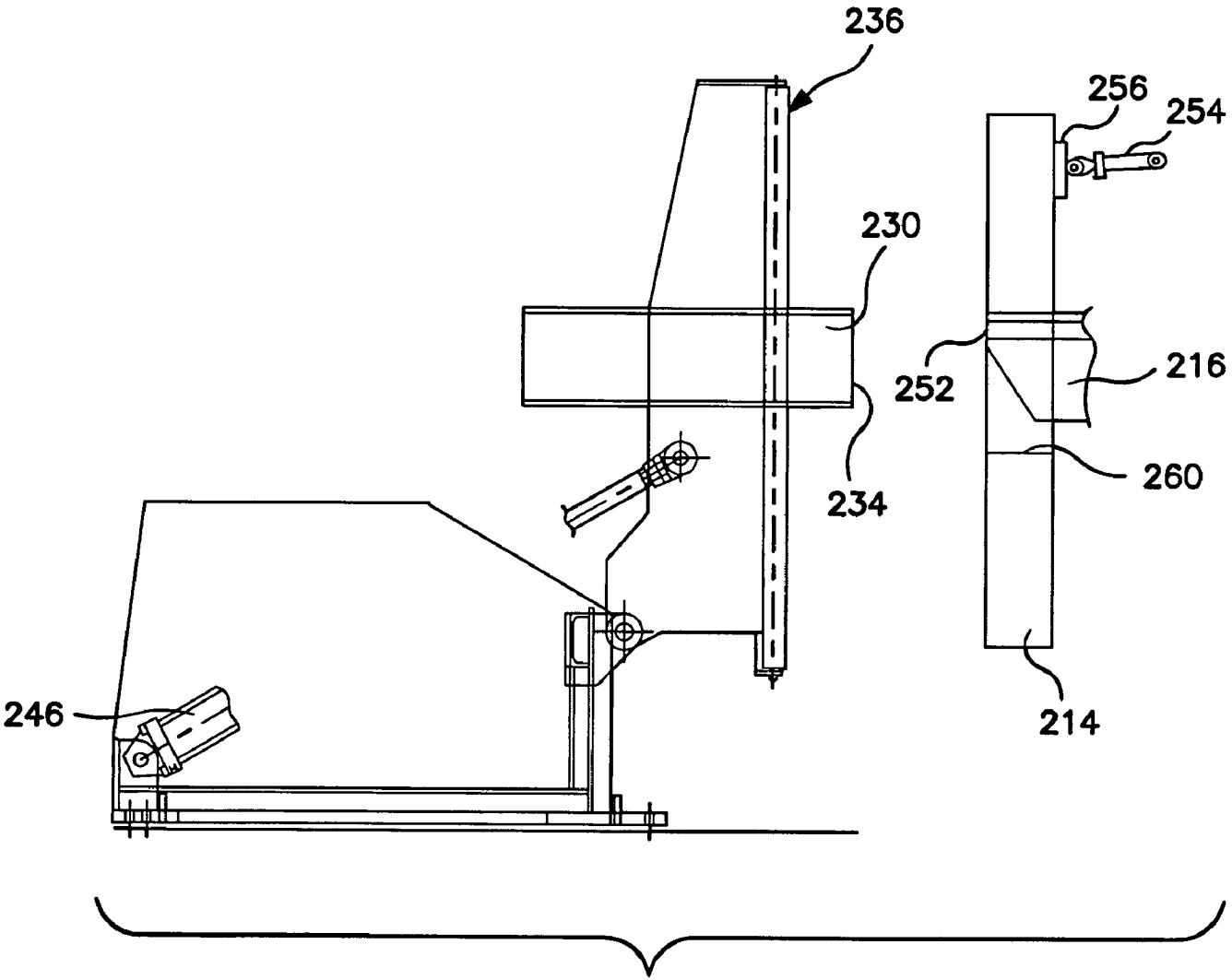
FIG. 6 is a side view of a downender transport table in a vertical configuration.
Figure 7:
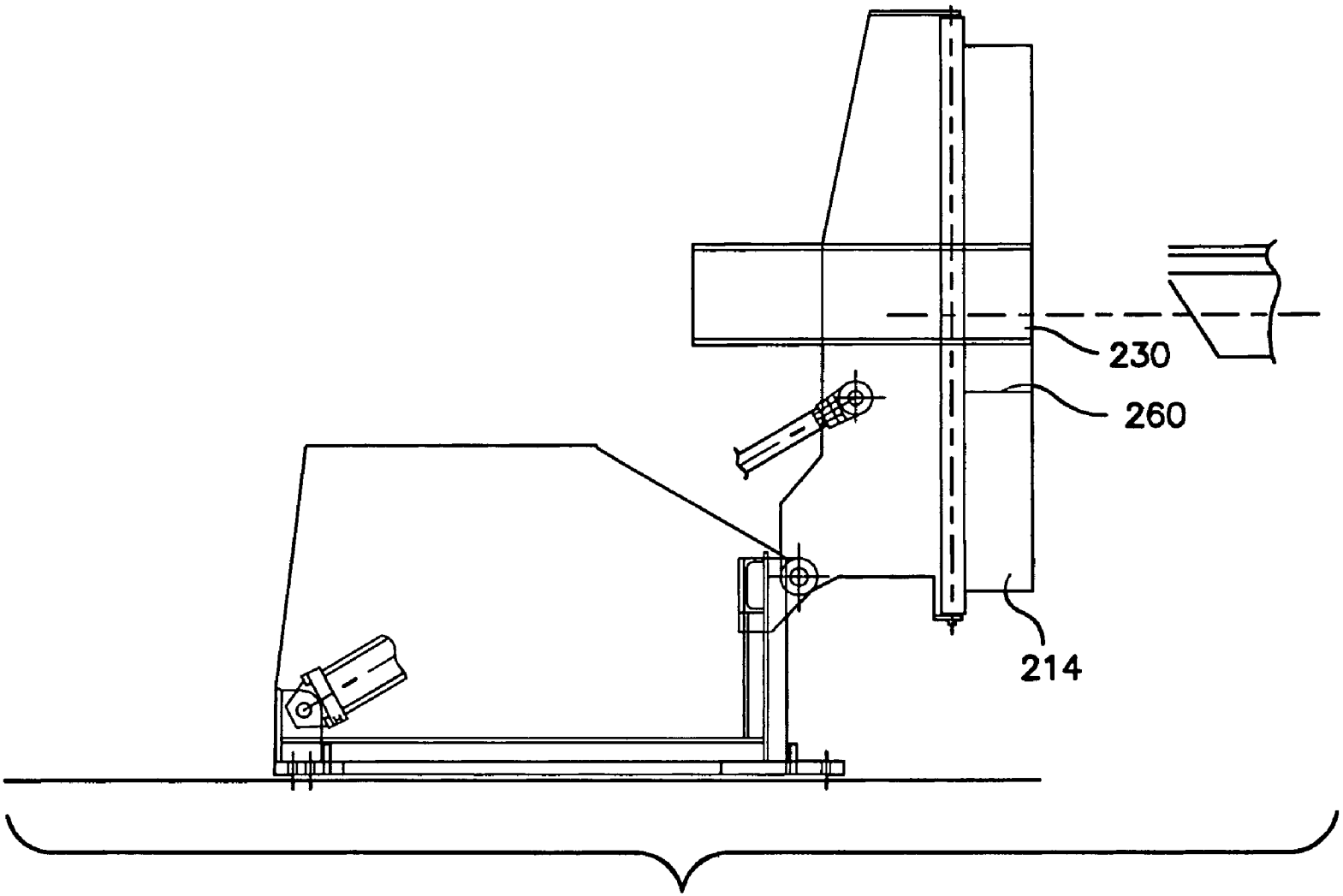
FIG. 7 is a side view of a downender transport table in a vertical configuration after receipt of a steel coil.

Turning to FIG. 6, when piston 246 is in its second, extended position, upper edge 236 of upper portion 242 is vertical. Arbor 230 is now shown in its second, extended position. When upper portion 242 is vertical, the arbor 230 is axially aligned with one of the arms 216 of the turnstile, with first arbor end 234 adjacent to first end 252 of arm 216 of the turnstile. Arm 216 supports steel coil 214 by slidably engaging inner surface 260 of steel coil 214. The turnstile includes a pushing mechanism, shown here as piston 254, and ram 256, for pushing steel coil 214 along arm 216 of the turnstile in the axial direction, and onto arbor 230 of downender transport table 210. As will be appreciated by those skilled in the art, the pushing mechanism may take a number of forms. For example, it may be in the form of a chain drive or it may rely on gravity to move the steel coil in the desired direction. Arbor 230 of downender transport table 210 receives steel coil 214 by slidably engaging inner surface 260 of steel coil 214, as shown in FIG. 7.

Figure 8:
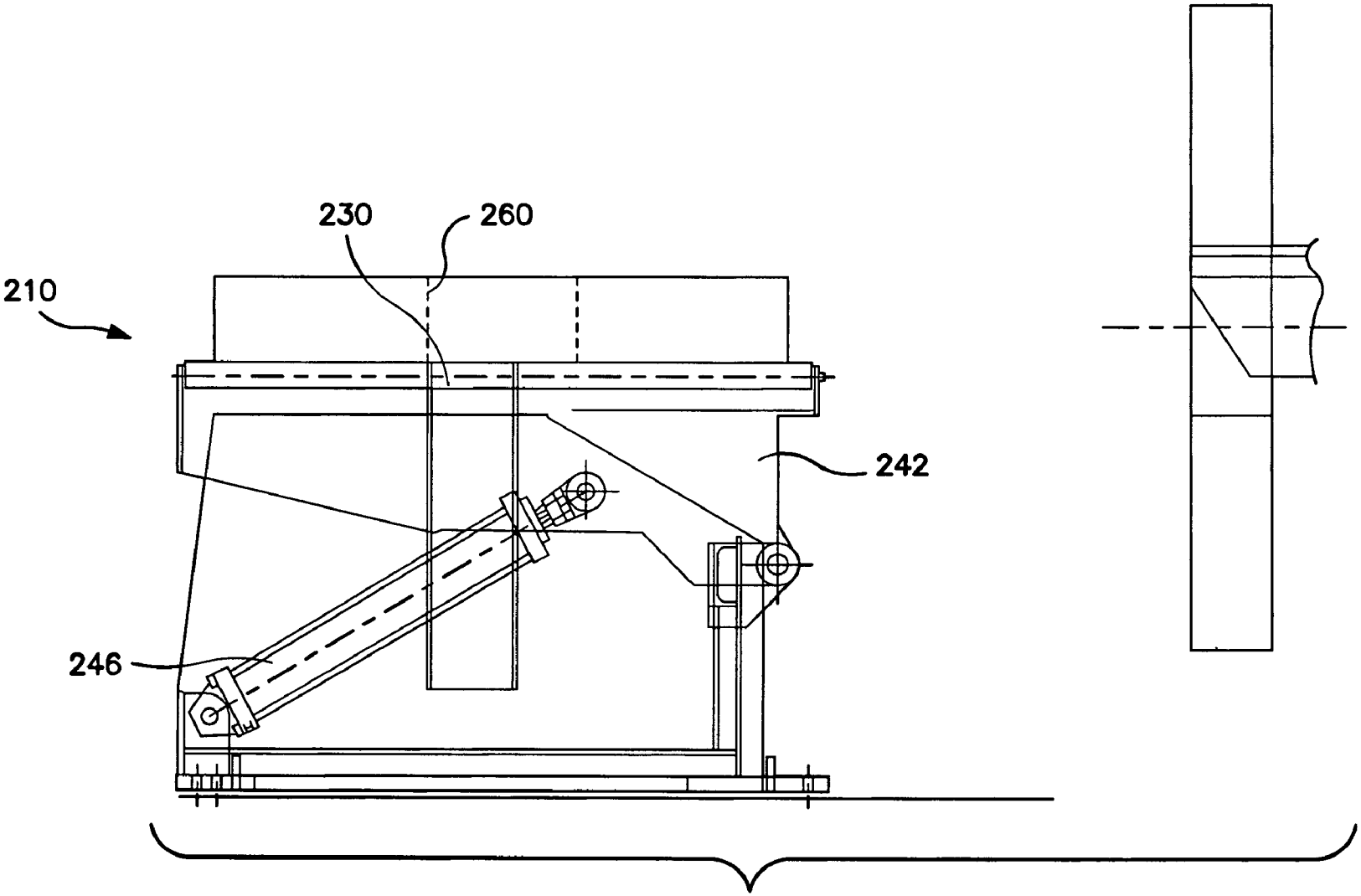
FIG. 8 is side view of a downender transport table in a horizontal configuration after receipt of a steel coil.

FIG. 8 shows downender transport table 210 after piston 246 has returned to its first, retracted position, returning upper hinged portion 242 to a horizontal configuration. Arbor 230 has also moved to its first, retracted position, disengaging arbor 230 from the inner surface 260 of steel coil 214.

As illustrated in FIG. 4 after downender transport table 210 returns to its horizontal configuration with steel coil 214, the inner diameter of steel coil 214 is engaged by coil catcher 262. Within processing line 200 is arbor guide channel 264 located at the approximate center of downender transport table 210. Arbor guide channel 264 is operably associated with center channel 266, which extends from arbor guide channel 264 through transport tables 212*a–b* of processing line 200. The center channel further has first channel end 318 corresponding to arbor guide channel 264, and second channel end 270, corresponding to the distal end of processing line 200.

Idler sprocket 272 is disposed within center channel 266 near its first end 268. Drive sprocket 272 is disposed within center channel 216 at second end 270, and is driven by a motor. Drive chain 276 circumferentially surrounds idler sprocket 274 and idler drive sprocket 276.

Processing line 200 further comprises a plurality of rollers 278. While a few rollers 278 extend from the first side 226 to the second side 228 at the first end 222 of the processing line 200, most rollers 278 extend from the first side 22—to center channel 266, and from center channel 266 to the second side 228. In accordance with an aspect of this invention, the rollers 278 are preferably free-rolling and are not powered by any means—but of course could be powered if so desired.

Figure 9:
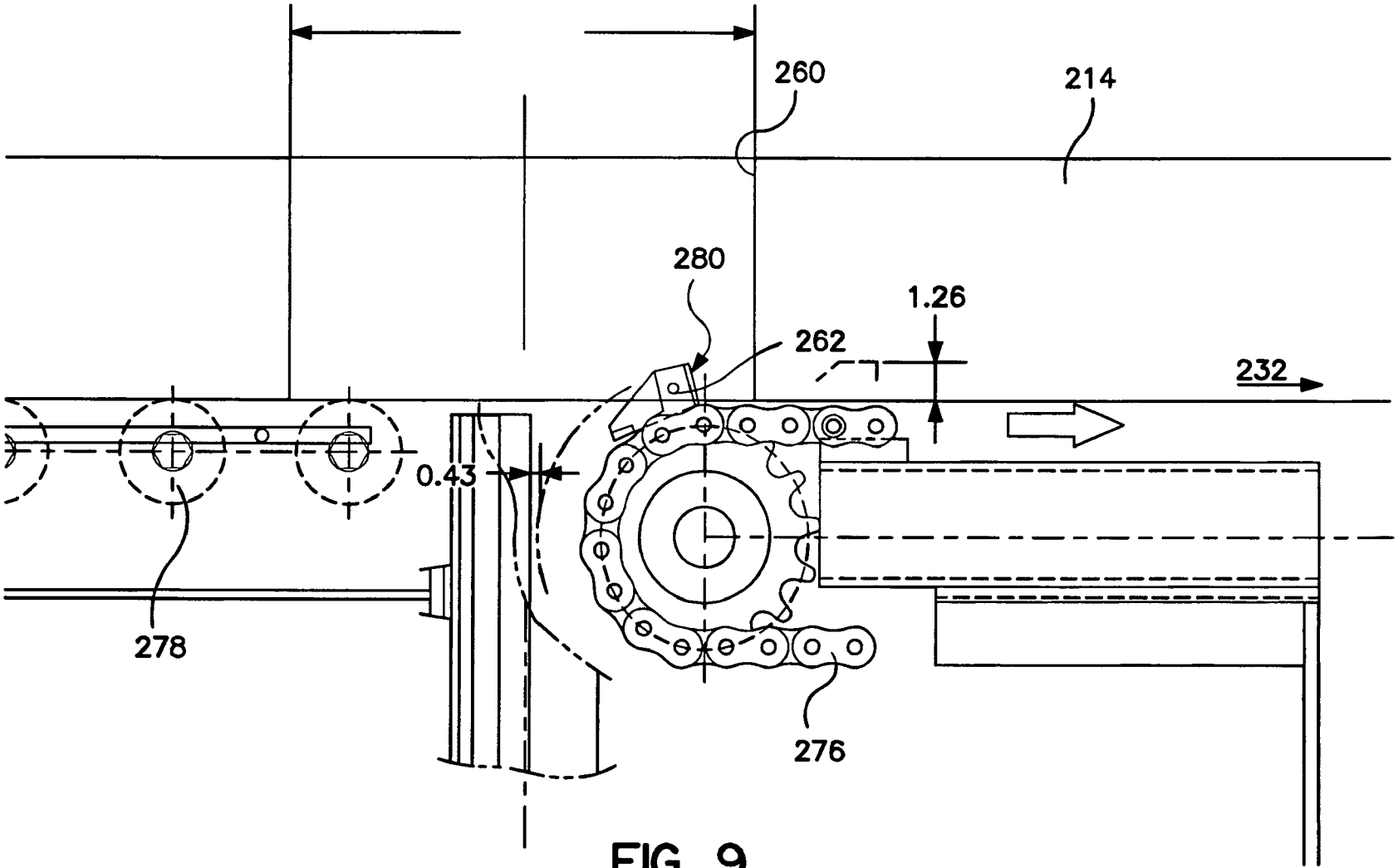
FIG. 9 is a side sectional view of a downender transport table including rollers and drive chain mechanism.

Referring to FIG. 9, drive chain 276 includes a plurality of coil catchers 262 disposed at predetermined intervals along the drive chain 276. The distance between successive coil catchers 262 in this embodiment is equal to the outer diameter of a steel coil 214, plus a given separation distance, which may vary according to the particular application. The distance between coil catchers may, of course, be adjusted depending upon the size of the coil and speed of the processing lines. Each coil catcher 262 has a leading face 280 which is perpendicular to drive chain 276. The leading face 280 of coil catcher 262 may be shaped to conform to inner surface 260 of steel coil 214.

The direction of rotation of drive sprocket 274 is configured such that, when coil catchers 262 are above the table surface, they move in flow direction 232, and when coil catchers 262 are below the table surface, they flow in the opposite direction. As coil catcher 262 moves in flow direction 232, leading face 280 of coil catcher 262 engages inner surface 260 of steel coil 214. As the drive chain pulls coil catcher 262 in flow direction 232, coil catcher 262 pushes steel coil 214 along the downender transport table. The steel coil moves relatively freely because it rests and is transported on free-rolling rollers 278.

Rollers 278 in this embodiment are not required to be motorized because drive chain 276 and coil catchers 262, as opposed to the rollers themselves, move the steel coils along the processing line. As a result, the present invention has a simple drive mechanism, as opposed to the more complex drive mechanisms of other prior art embodiments. Rollers 278, in this preferred embodiment, are less subject to unnecessary wear because they are not constantly rotating. In addition, rollers 278 are less than half the length of the prior art rollers. This is possible because each roller only extends to center channel 266, which is preferably halfway between first side 226 and second side 228 of the downender transport table 210. The shorter length of rollers 278 lowers the cost of replacing individual rollers and results in extended life of the rollers, as the rollers will encounter less bending stress. Furthermore, coil catcher 262 prevents steel coils 214 from moving from side to side as they move in the direction of flow path 232.

Figure 10:
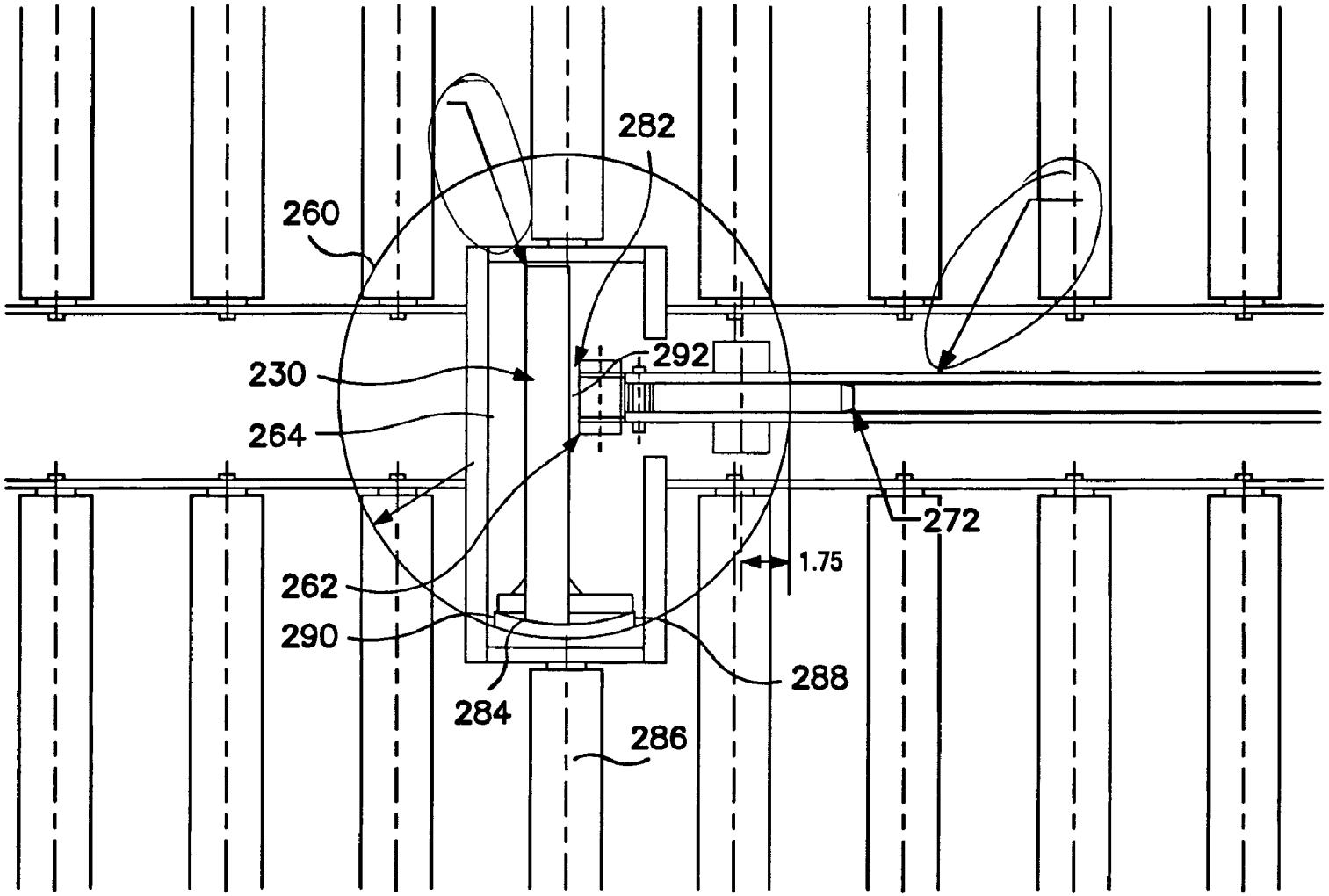
FIG. 10 is a top plan view of a downender arbor according to the present invention.

FIG. 10 illustrates an improved arbor 230 for receiving steel coils 214. Arbor 230 is disposed within arbor guide channel 264, immediately adjacent to idler sprocket 272. The arbor 230 comprises a support portion 282 and coil engaging portion 284. The coil engaging portion 284 is preferably shaped so that it conforms to inner surface 260 of steel coil 214. The coil engaging portion 284 of arbor 230 has center 286, which is the radial median of a first coil engaging portion end 288 and a second coil engaging portion end 290. The support portion 282 of arbor 230 is preferably offset from center 286 of coil engaging portion 284. More particularly, support portion 282 is configured so as to provide sufficient clearance between coil catcher 262 and arbor 230 as shown by gap 292. The offset design of arbor 230 allows arbor 230 to extend and retract within arbor guide channel 264 without interfering with the coil catcher 262.

The use of coil catcher 262 on inner surface 260 of steel coil 214 also automatically places steel coil 214 on the approximate center of the transport table, rather than using a separate manipulation means such as bumpers or human intervention to center the coil. The automatic centering of steel coil 214 by coil catcher 262 means that the position of the steel coil is relative to the sides of the table is known. This permits banding machine 212*a* to apply three steel bands to steel coil 214 at about the same time, rather than one at a time, and without reorientation of steel coil 214 on banding machine 212*a*.

After steel coil 214 has been secured by steel bands, the coil would travel to the next area on the transport table where the coil would receive a plurality of, preferably three equally spaced, spacer sticks on the coils upper surface. Coil 214 would continue to travel across the transport table until arriving at coil holder station 212*b*. Coil holder station 212*b* would receive multiple steel coils 214 stacked one on top of another separated by the spacer sticks. From coil holder station 212*b* coils 214 would be transported to receiving turntable 208 by stacker 206.

The foregoing description and drawings merely explain and illustrate the invention and the invention is not limited thereto except insofar as the appended claims are so limited, inasmuch as those skilled in the art, having the present disclosure before them will be able to make modifications and variations therein without departing from the scope of the invention.

What is claimed is:

1. An apparatus for moving an object from a substantially vertical position to a substantially horizontal position for presenting said objects for further handling, the apparatus comprising:

a table having a plurality of rollers and a downender receiving section for receiving said object and then translating said object between a substantially vertical position and a substantially horizontal position;

said object having an inner diameter which circumference is an inner surface and an outer diameter which circumference is an outer surface;

said downender receiving section of said table having an arbor for engaging said inner surface of said object for securing said object to said table during translation between said substantially vertical and substantially horizontal positions;

a guide channel disposed in said table;

an idler sprocket operably positioned in relation to said table to cooperate with said guide channel;

a drive sprocket operably positioned in relation to said table to cooperate with said guide channel:

a drive chain engaging both said idler sprocket and said drive sprocket so as to operably connect said idler sprocket to said drive sprocket;

at least one catcher positioned on said drive chain and positionable within said guide channel, where said at least one catcher is capable of releasably engaging said inner surface of said object; and said drive chain being driven so that said at least one catcher engages said inner surface of said object to move said object along said table when said object is in said substantially horizontal position.

2. The invention according to claim 1 wherein said at least one catcher comprises a plurality of catchers spaced at regular intervals on said drive chain.

3. The invention according to claim 2 in which said regular intervals are dependent upon said inner diameter of said object and said drive chain speed.

4. The invention according to claim 1 wherein said guide channel is positioned so as to be substantially centered within said table.

5. The invention according to claim 4 wherein said rollers on a first side of said guide channel are substantially equal in length to said rollers on a second side of said guide channel.

6. The invention according to claim 1 in which said at least one catcher conforms to said inner surface of said object when said at least one catcher engages said inner surface so as to minimize the space taken up by said at least one catcher within said inner diameter of said object.

7. The invention according to claim 1 in which said arbor comprises an object engaging portion for releasable engagement of said inner surface of said object and a support portion operably associated with said object engaging portion.

8. The invention according to claim 7 in which said support portion emanates from said object engaging portion and where said support portion is aligned with but off-center from said inner diameter of said object for maximizing space available within said inner diameter of said object.

* * * * *